United States Patent [19]

Petinelli et al.

[11] Patent Number: 4,621,169

[45] Date of Patent: Nov. 4, 1986

[54] ELECTRIC CABLE CONSTRUCTION AND USES THEREFOR

[75] Inventors: Jean-Claude Petinelli, Dusseldorf, Fed. Rep. of Germany; Dominique Bertier, Mortain, France

[73] Assignees: Compagnie Francaise de Raffinage; Acome, Societies Anonyme, both of Paris, France

[21] Appl. No.: 703,806

[22] PCT Filed: Jun. 21, 1984

[86] PCT No.: PCT/FR84/00157

§ 371 Date: Feb. 21, 1985

§ 102(e) Date: Feb. 21, 1985

[87] PCT Pub. No.: WO85/00245

PCT Pub. Date: Jan. 17, 1985

[30] Foreign Application Priority Data

Jun. 21, 1983 [FR] France ..... 83 10258

[51] Int. Cl.[4] ..... H01B 7/28

[52] U.S. Cl. ..... 174/106 SC; 174/23 C; 174/102 SC

[58] Field of Search ..... 174/102 SC, 105 SC, 174/106 SC, 120 SC, 23 R, 23 C

[56] References Cited

U.S. PATENT DOCUMENTS

| | | | |
|---|---|---|---|
| 3,671,663 | 6/1972 | Seifert et al. | 174/102 SC X |
| 3,878,146 | 4/1975 | Charlton | 174/23 C |
| 4,095,039 | 6/1978 | Thompson | 174/120 SC X |
| 4,104,480 | 8/1978 | Thompson | 174/23 C |
| 4,190,570 | 2/1980 | Kaufman et al. | 174/23 C X |
| 4,324,453 | 4/1982 | Patel | 174/23 C X |
| 4,435,613 | 3/1984 | Gaubert | 174/23 C X |
| 4,440,974 | 4/1984 | Naudet | 174/106 SC X |
| 4,526,707 | 7/1985 | Kutsuwa et al. | 174/102 SC X |

FOREIGN PATENT DOCUMENTS

| | | | |
|---|---|---|---|
| 1484850 | 9/1977 | United Kingdom | 174/23 C |

*Primary Examiner*—Arthur T. Grimley
*Assistant Examiner*—Morris H. Nimmo
*Attorney, Agent, or Firm*—A. Thomas S. Safford

[57] ABSTRACT

The invention encompasses an electric cable which is made up of a metallic shield, a semiconducting polymer sheath surrounding a cable conductor and a moisture-proofing layer in the form of a semiconducting hydrophobic gel. This construction assures an effective moisture barrier between the metallic shield and the semiconducting polymer layer by providing a semiconducting gel fully compatible with both.

9 Claims, 6 Drawing Figures

ELECTRIC CABLE CONSTRUCTION AND USES THEREFOR

The present invention relates to a new electric cable construction wherein the conductor is covered by several successive layers of materials comprising a hydrophobic and semiconducting moistureproofing gel disposed between a likewise semiconducting polymer layer and a metallic shield.

The invention further relates to the use of said construction for the continuous grounding of electric conductors and for the radial distribution of the field in power cables.

Figure 1A:
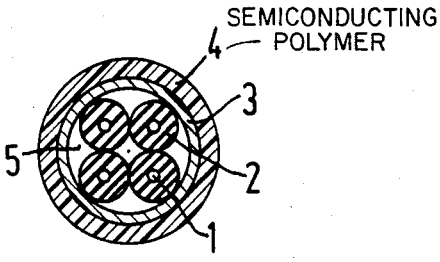
FIG.1a PRIOR ART
Figure 1B:
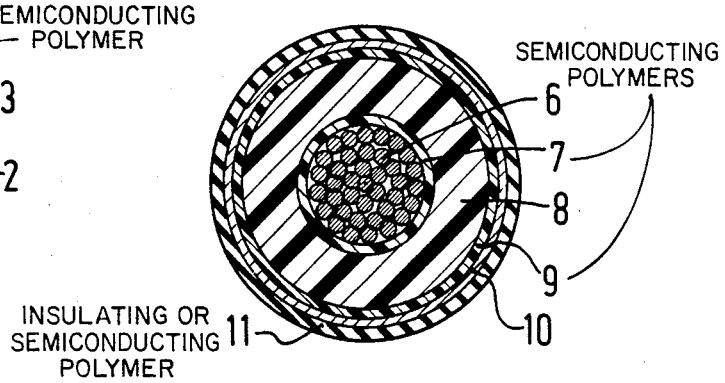
FIG.1b PRIOR ART
Figure 2A:
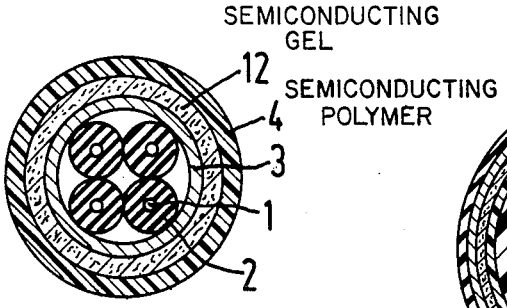
Figure 2B:
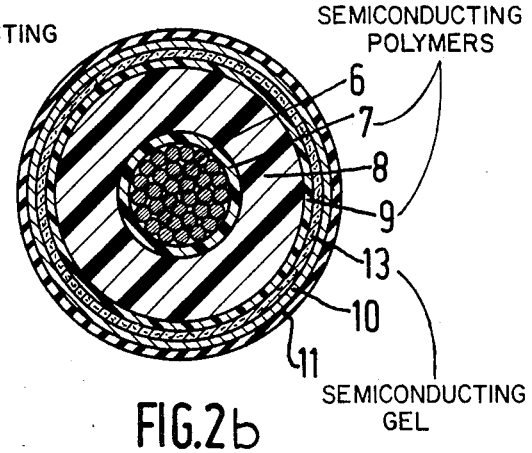
Figure 2C:
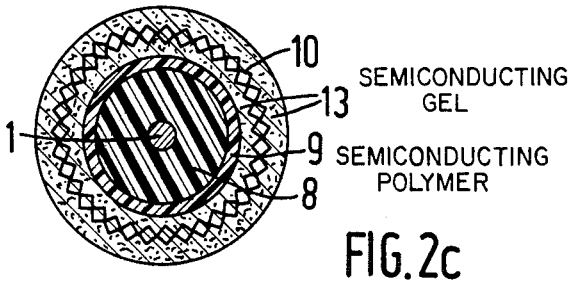
Figure 3:
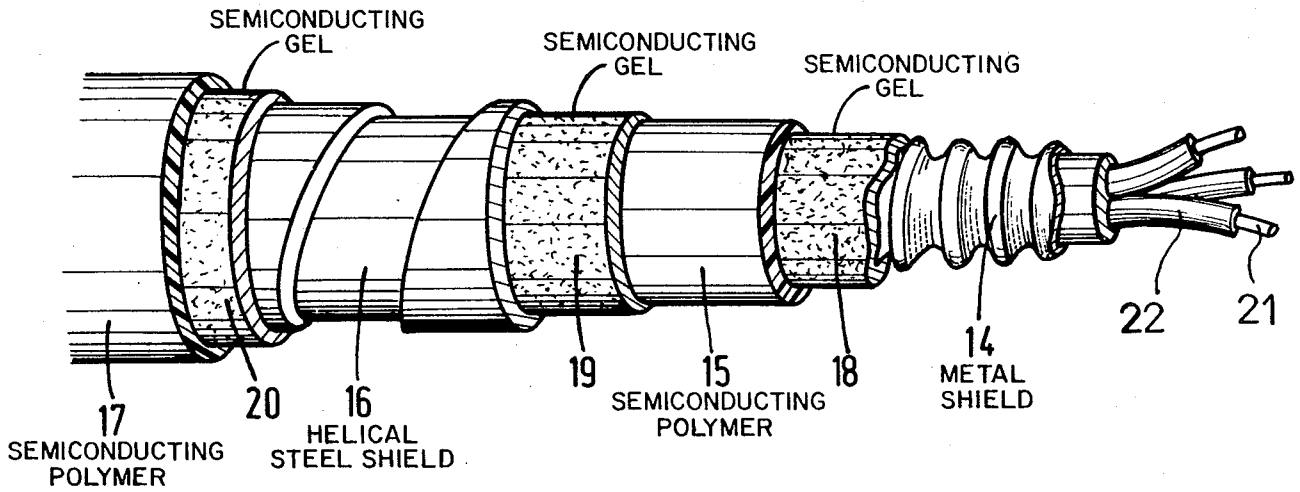

As is known, the advent of semiconducting polymeric materials has brought great improvements to the manufacture of electric cables with respect to both communications cables and power transmission cables. Such known cable constructions will now be described with reference to FIG. 1*a* and 1*b* of the accompanying drawings, wherein:

FIGS. 1*a* and 1*b* are cross sections of two types of prior-art cables;

FIGS. 2*a* and 2*b* are similar sections of the same cables embodying an improvement in accordance with the invention, FIG. 2*c* being a section of a coaxial cable in accordance with the invention; and FIG. 3 is a perspective view, cut away to illustrate a cable construction in accordance with the present invention.

The cable construction shown in FIG. 1*a* is that of a conventional communications cable. Said cable comprises, for example, a plurality of conducting wires 1, made of a conducting material such as copper or aluminum and covered by an insulating jacket 2. The assembly of conducting wires so jacketed is enclosed in a conducting metallic sheath 3 forming a shield, which in turn is surrounded by a protective layer formed of a semiconducting polymer 4 which makes good physical contact with the metallic surface 3. The space 5 left free between the insulating jacket 2 and the metallic surface 3 may be filled conventionally with a sealant.

The power transmission cable shown in FIG. 1*b*, which is also of a known type, comprises a strand of conducting wires 6 which is surrounded by a semiconducting polymer sheath or layer 7. Around this sheath 7 there is disposed an insulating material 8 which in turn is surrounded by a second semiconducting polymer layer 9 that is sheathed with a layer of conducting metal 10 forming a shield and consisting of copper, steel or aluminum, for example. The outer covering 11, in turn, may consist of an insulating or semiconducting polymer sheath.

However, the usual cables of the type of those illustrated by FIGS. 1*a* and 1*b* or consisting of an assembly of strands, such as multipolar cables, have the drawback of not being perfectly moisture-tight and of not assuring perfect contact between the semiconducting sheath and the metallic surface. In fact, as a result of shock to or twisting or cracking of the cable, or of condensation occurring at the level of the free spaces, or of longitudinal propagation starting at cable joints or splices, the region between the semiconducting polymer (reference numerals 4 in FIG. 1*a* and 9 in FIG. 1*b*) and the metallic shield (reference numerals 3 in FIG. 1*a* and 10 in FIG. 1*b*) is always apt to allow traces of moisture to come in contact with the metal, thus causing the latter to deteriorate by a process of disintegration, oxidation and/or corrosion. This drawback can be partially limited by incorporating between the metallic sheath and the semiconducting polymer a layer of a hydrophilic material such as carboxymethylcellulose or of a hygroscopic material such as a semiconducting clay whose swelling in the presence of moisture will prevent the water from spreading along the conducting metal. However, these products will not prevent local corrosion of the shields.

The object of the present invention thus is to provide an effective moisture barrier between the metallic shield and the semiconducting polymer layer of such electric cable constructions.

To this end, the invention has as its object an electric cable construction of the type comprising at least one metallic shield and at least one semiconducting polymer layer which surround at least one cable conductor, characterized in that between said metallic shield and said semiconducting polymer layer there is interposed a moistureproofing layer comprising a semiconducting and hydrophobic gel.

For the purposes of the present application, the term "metallic shield" means not only a conducting sheath of the type illustrated by FIGS. 1*a* and 1*b* but also any metal wire fabric, whether woven, braided or "wound", to use the term current in the art.

The semiconducting and hydrophobic gel used in accordance with the invention is designated by the reference numerals 12 and 13, respectively, in FIGS. 2*a* and 2*b*, in which the components already described with reference to FIGS. 1*a* and 2*a* carry the same reference numerals. Said gel is interposed between the metallic shields 3 and 10, respectively, and the semiconducting polymer sheaths 4 and 9, respectively. Because of its hydrophobic properties, it insulates the electric cables from moisture while at the same time providing for effective continuous grounding by reason of its special dielectric properties.

It should be noted that such continuous grounding is also applicable, on the same principle, to other types of cables, and particularly to power transmission cables.

FIG. 2*c* shows a special application of the cable construction in accordance with the invention to a low-noise coaxial cable. In the usual coaxial cables, the rubbing of the metallic braiding against the insulation is generally the source of triboelectric noise. In FIG. 2*c*, the semiconducting gel forms the moistureproofing layer, designated by the reference numeral 13, which is interposed between the semiconducting polymer layer 9 covering the insulating material 8, and the metallic braid designated by the reference numeral 10. This arrangement permits a large portion of the triboelectric noise to be suppressed.

The introduction of the semiconducting and hydrophobic moistureproofing gel between the metallic shield and the semiconducting polymer layer further makes it possible, by reason of the dielectric properties of that layer, to provide for effective radial distribution of the field in power transmission cables.

A first advantage of the present invention stems from the fact that the semiconducting gel is fully compatible both with the metallic shield, to which it adheres completely and which it protects from any traces of moisture or other causes of corrosion of the metal, and with the semiconducting polymer layer, by reason of the very nature of the constituents of the gel, since these are unable to diffuse into the polymer layer, to which additives and conductive charges which are of the same nature as those going into the composition of the gel are preferably added.

A second advantage of the present invention is due to the fact that because of the presence of the semiconducting gel the semiconducting polymer layer need not simultaneously provide effective protection of the metallic shield and assure maximum adhesion to the metal. The semiconducting polymer layer may therefore be selected solely on the basis of the mechanical properties required for protection of the cable, apart from the desired electrical properties.

A third advantage of this cable-sheathing construction results from the fact that the semiconducting gel, by its fluidity and its plasticity, also forms an effective moisture barrier and hence provides excellent electrical contact between the semiconducting polymer layer and the metallic shield which surrounds it, regardless of the mechanical stresses to which the cable may be subjected, while at the same time providing effective protection for its component parts.

Moreover, a further advantage of the cable-sheathing construction in accordance with the invention is due to the fact that the fluidity and plasticity properties of the moistureproofing layer are not significantly affected by the temperature since the dynamic viscosity at 20° C. is under 100,000 centipoises and at 100° C. ranges from 50,000 to 100,000 centipoises.

Finally, this cable-sheathing construction considerably facilitates the jointing of the cables during their installation.

This new type of cable-sheathing construction thus protects the metallic shield with increased reliability against corrosion and assures excellent grounding or excellent radial distribution the electric field while providing improved protection for the cable itself by reinforcing its outer sheath.

In the moistureproofing compositions consisting of semiconducting gels which are suitable for being introduced into the electric cable-sheathing construction in accordance with the present invention, a proportion of from 50 to 95 weight percent of paraffinic or naphthenic hydrocarbon compounds is preferably used which have been selected so that at temperatures of the order of 50° C. and up they will not diffuse into the polyethylene, polypropylene, polybutylene, polyvinyl chloride or other cellular insulation material going into the composition of the sheath.

These hydrocarbon compounds may be of a petroleum, vegetable or synthetic origin or may be mixtures of several of these oils. Advantageously, distillation fractions of oils and/or petrolatum obtained from such fractions are used. In general, less than 5 percent of these oils have a boiling point under 350° C.

When they are of synthetic origin, these hydrocarbon compounds are advantageously polymers obtained from olefins having three or four carbon atoms, or mixtures thereof. Synthetic oil fractions with a weight-average molecular weight ranging from 200 to 4,000, and more particularly from 400 to 1,500, are then advantageously used.

To these oils there is added in a known manner a conductive charge such as a powdered metal or metal oxide, the metal being advantageously zinc, copper or aluminum, or carbon black, a mixture of varying particle-size fractions of carbon black, or graphite, or, finally, a mixture of the latter. The proportion of the conductive charge in relation to that of the oil is determined primarily on the basis of the electrical resistivity and of the viscosity which the semiconducting and hydrophobic gel is to possess under the conditions of manufacture and of use of the electric cable into whose sheath it will be introduced. That proportion may therefore range from 5 to 50 percent by weight of the moistureproofing gel, as the case may be, and more particularly from 5 to 40 percent.

A particularly interesting composition in accordance with the invention is obtained when highly conductive carbon blacks of the type of Ketjen EC or Phillips XE2 are used. These blacks, which can be used in lower concentration than conventional blacks for a given resistivity, permit compositions to be obtained which are also more hydrophobic. The concentration of these blacks should range from 5 to 15 weight percent, depending on whether they are used alone or not, and depending on the desired resistivity.

While such additives are not necessary for all oils, the composition of the gel may include stabilizers, adhesion promoters such as petroleum-derived resins, thickeners such as unsaturated polyolefins in a proportion ranging from 0 to 20 percent, and, finally, metal passivators such as benzotriazoles, substituted or unsubstituted, or any other known substance that is capable of providing a similar function, in a proportion ranging from 0 to 2 percent, depending on the nature of the oil, of the conductive charge or of the metal going into the composition of the sheath (or armor) of the cable.

The semiconducting and hydrophobic gels going into the cable-sheathing construction of the present invention preferably have the following properties:

An electrical resistivity of under 40,000, and preferably under 10,000, ohm-cm when the cable is intended to be grounded, or a resistivity of under 20,000 ohm-cm for the so-called homopolar cables;

a viscosity at 100° C. ranging from 10,000 to 100,000 centipoises;

good adhesion to the metal at low temperature (−10° C., in conformity with standard CNET CM 35); and a ring-and-ball test temperature, measured in conformity with standard NFT 66008, of over 50° C., and preferably between 100° and 200° C.

Tests have been conducted for many years with a view to rendering thermoplastic sheathing materials semiconducting by incorporating metals, metal oxides or the usual grades of carbon blacks into them. However, to obtain a sufficiently high electrical conductivity, substantial amounts of conductive charge had to be introduced, as a result of which the mechanical properties of the thermoplastics deteriorated and their properties of adhesion to the metallic shield which they were supposed to protect were adversely affected. The introduction of a semiconducting gel which forms an effective moisture barrier between the sheath and the metal thus permits the use of sheathing materials having improved properties.

The semiconducting polymers which are suitable for use in the electric cable construction to which the present invention relates include compositions comprising mainly a polymer of ethylene, or a mixture of a homopolymer and a copolymer of ethylene, or a mixture of an ethylene copolymer and a propylene, vinyl acetate or ethyl acrylate monomer or any other monomer, as generally known. For the purpose of imparting to the sheath the necessary rigidity and strength, compositions containing over 70 percent ethylene copolymer or high- or medium-density polyethylene in particular are used.

The polyethylene used advantageously has a specific gravity between 0.90 and 0.95 and a melt index between 0.1 and 2. Any plastic material in which conductive charges can be incorporated, and especially plasticized polyvinyl chloride, is suitable for use.

The composition of the polymer further includes a conductive charge, which advantageously is of the same nature as that contained in the semiconducting gel that goes into the cable-sheathing construction. The proportion of this charge may likewise range from 5 to 45 percent, depending on the resistivity and on the ruggedness which this type of sheath is to have and on the anticipated conditions of use of the electric cable. For the purpose of continuous grounding, that proportion advantageously ranges from 6 to 15 weight percent.

The semiconducting polymer layers advantageously have the following composition (in weight percent):

| | |
|---|---|
| Polyethylene, or ethylene/ethyl acrylate copolymer, or ethylene/vinyl acetate copolymer, or ethylene/polypropylene copolymer, or any combination of these four polymers | 10 to 100% |
| Carbon black | 5 to 20% |
| Antioxidant mixture | 0.1 to 2% |

The polymer layers going into the cable-sheathing construction of the present invention preferably have the following properties:

A resistivity of under 10,000, and preferably under 1,000, ohm-cm when the shield is to be grounded, or from 10 to 10,000 ohm-cm when the field is to be radially distributed within an insulation;

an elongation at rupture of over 100 percent, and preferably over 300 percent (standard NFT 51,034); and a Shore D hardness between 35 and 70 and preferably, between 50 and 70.

Finally, the sheaths should have good stress-cracking resistance.

With a view to checking the ruggedness, durability and grounding properties of the cable constructions in accordance with the present invention, applicants have carried out comparative tests with them and with cable constructions of a conventional type.

Thus, three cables A, B and C with a length of 50 meters and a construction as diagrammed in FIG. 1*a* (for cable A) and in FIG. 2*a* (for cables B and C) were buried in soils of varying nature.

The compositions of these cables are given in Table 1 which follows.

TABLE 1

| A | B | C |
|---|---|---|
| Semiconducting and hydrophobic moisture-proofing layer | Oil 600N (4) 64.5%<br>APP5 Vestoplast (3) 11.5%<br>Carbon black XE2 (1) 4.0% | Petrolatum GATSCH 5 (4) 48%<br>Polybutylene NAPVIS of 10 (5) 15%<br>Polyolefin VESTOPLAST 508 (3) 12%<br>Carbon black XE2 (1) 5%<br>Graphite JPF/B8/7C (6) 20%<br>Antioxidant Reomet 38 (7) 0.05% |
| Semiconducting polymer sheath | MARLEX 3802 (1) 69.8%<br>ELVAX 360 (2) 30.0%<br>Carbon black XE2 (1) 10.0%<br>Antioxidant Reomet 38 0.2 | MARLEX 3802 (1) 60.8%<br>ELVAX 360 (2) 25.0%<br>Carbon black XE2 (1) 9.0%<br>Graphite 5%<br>Antioxidant 0.2 0.2 |
| Metallic shield | Steel | Steel |
| | | MARLEX 3802 (1) 27.0%<br>ELVAX 360 (2) 62.9%<br>Carbon black XE2 (1) 10.0%<br>Antioxidant Reomet 38 (7) 0.2%<br>Aluminum |

(1) A product marketed by Phillips Petroleum.
(2) A product marketed by DuPont de Nemours.
(3) A product marketed by Vera Chimie.
(4) A product marketed by Total.
(5) A product marketed by Naphtachimie.
(6) A product marketed by J. Parade et Fils.
(7) A product marketed by Ciba-Geigy.

While the resistance to ground of the shields of the three types of cable were comparable, when they were grounded (on the order of from 10 to 25 ohms per 50 meters) only the resistance of the shields of cables B and C to ground remained substantially constant with time, being from 40 to 60 percent lower than the resistance of cable A at the end of two years under the same conditions of use.

In the moisture-tight cables having the construction in accordance with the invention, the presence of a semiconducting hydrophobic gel between the metallic shield and the semiconducting polymer layer thus permits said shield and said layer to be in constant electrical contact with each other without the use of any auxiliary grounding of the shield, and without any risk of accidental corrosion of the shield as a result of disintegration due to inadequate contact between shield and semiconducting layer.

Further comparative tests were run with two other types of cables, D and E, buried under the same conditions, with a view to demonstrating the better electrical continuity of the cable constructions in accordance with the invention.

A first cable D had the construction illustrated in FIG. 3. A ring-type metallic shield 14 consisting of copper surrounds the conducting wires 21, which are jacketed by insulation 22. Around the shield 14 there are successively disposed an intermediate semiconducting polymer layer 15, a helically-wound steel shield 16, and a semiconducting-polymer outer jacket 17. A semiconducting gel 18, 19 and 20, respectively, was injected between the layers 14 and 15, 15 and 16, and 16 and 17 to render the cable moisture-tight.

The polymer layers and the semiconducting gel going into the composition of cable D were produced with formulations identical to those of cable C, described earlier.

The electrical properties of cable D were compared with those of a cable E constructed on the same pattern but without introduction of a semiconducting moisture-proofing gel at 18, 19 and 20.

Table 2 which follows gives the resistance values of the shields in ohms per 50 meters of buried cable for cables D and E.

TABLE 2

| | D | E |
|---|---|---|
| Resistance between steel shield 16 and ground | 8.15 | 8.5 |
| Resistance between copper shield 14 and ground | 26.6 | 317 |
| Resistance between copper shield 14 and steel shield 16 | 18.8 | 309.5 |

It is apparent from this table that the best results are obtained with cable D. In fact, although the resistances of the shield 16 to ground are comparable, the resistance to ground of shield 14 in the moisture-tight version D is lower by a factor of about 15 than that of version E of said cable which has not been moistureproofed, while the resistance between shields is about 10 times smaller.

In the moisture-tight cable construction D, a semiconducting and hydrophobic moistureproofing gel conforming to the metallic surface of the shield or shields and to the semiconducting polymer layer enhances the electrical conductivity between shields and sheaths while forming a longitudinal moisture barrier. The three component parts of this cable sheathing thus are in continuous parallel contact with one another, which makes it possible to dispense with frequent grounding of the external structure of the cables and to promote the reducing effect.

We claim:

1. Electric cable comprising at least one cable conductor, at least one metallic shield, at least one semiconducting polymer layer surrounding said cable conductor, and a semiconducting moistureproofing layer in the form of a hydrophobic gel interposed between said metallic shield and said semiconducting polymer layer, both said layers having a resistivity of from under 10 to 100,000 ohm-cm, said semiconducting moistureprofing layer having a dynamic viscosity of less than 100,000 centipoises at 20° C. and between 50,000 and 100,000 at 100° C., said semiconducting moistureproofing layer containing at least 50 to 95 percent by weight of at least one hydrocarbon compound selected from the group consisting of paraffin and naphtha of petroleum, vegetable and synthetic origin, and said semiconducting moistureproofing layer containing at least 5 to 50 percent by weight of conductive charge selected from the group consisting of zinc, copper, aluminum, oxides thereof, carbon black and graphite.

2. Electric cable according to claim 1, wherein the resistivity of said moistureproofing layer is under 20,000 ohm-cm and the resistivity of said semiconducting polymer layer is under 40,000 ohm-cm.

3. Electric cable according to claim 1, wherein the metallic shield encloses the polymer layer and the moistureproofing layer both of which have a resistivity of less than 20,000 ohm-cm.

4. Electric cable according to claim 2, wherein the semiconducting polymer layer is used as an outer sheath and has a resistivity of less than 10,000 ohm-cm.

5. Electric cable according to claim 1, wherein the moistureproofing layer contains up to 20 percent stabilizers, thickeners and adhesion promoters.

6. Electric cable according to claim 2, wherein said semiconducting polymer layer is composed of from 10 to 100 percent by weight of a compound selected from the group consisting of polyethylene, ethylene/ethyl acrylate copolymer, ethylene/vinyl acetate copolymer, ethylene/polypropylene copolymer and any combination thereof, from 5 to 20 percent by weight of carbon black, and from 0.01 to 2 percent by weight of at least one stabilizer.

7. Electric cable according to claim 1, wherein said semiconducting polymer layer is composed of from 10 to 100 percent by weight of a compound selected from the group consisting of polyethylene, ethylene/ethyl acrylate copolymer, ethylene/vinyl acetate copolymer, ethylene/polypropylene copolymer and any combination thereof, from 5 to 20 percent by weight of carbon black, and from 0.01 to 2 percent by weight of at least one stabilizer.

8. Electric cable according to any one of claims 1 or 7, wherein said semiconducting polymer layer and said moistureproofing layer contain the same semiconductive charges and protective additives.

9. Electric cable according to any one of claim 1 or 7, wherein the shield is composed of a metal selected from the group consisting of steel, zinc, copper and aluminum.

* * * * *